US005806922A

United States Patent [19]

Mendelovich

[11] Patent Number: 5,806,922

[45] Date of Patent: Sep. 15, 1998

[54] HIGH CHAIR

[75] Inventor: Israel Mendelovich, Rehovot, Israel

[73] Assignee: Litaf Industries (1994)Ltd., Rehovot, Israel

[21] Appl. No.: 801,907

[22] Filed: Feb. 14, 1997

[30] Foreign Application Priority Data

Feb. 21, 1996 [IL] Israel ..... 117219

[51] Int. Cl.[6] ..... A47C 13/00; A47D 1/10

[52] U.S. Cl. ..... 297/130; 297/134; 297/119; 297/129

[58] Field of Search ..... 297/134, 130, 297/118, 119, 440.1, 129; 108/12, 13

[56] References Cited

U.S. PATENT DOCUMENTS

| | | | |
|---|---|---|---|
| 2,529,687 | 11/1950 | Greenbaum | 297/134 |
| 2,667,207 | 1/1954 | Magyar | 297/134 |
| 2,968,338 | 1/1961 | Reese | 297/134 |
| 3,397,101 | 8/1968 | Leimgruber | 297/134 |
| 3,570,418 | 3/1971 | Gooding | 297/440.1 |
| 3,744,845 | 7/1973 | Sooker | 108/12 |

FOREIGN PATENT DOCUMENTS

| | | | |
|---|---|---|---|
| 22814 | 1/1906 | Austria | 297/134 |

OTHER PUBLICATIONS

Baby Products by Evenflo, Evenflo Juvenile Furniture Company, Inc., Piqua, Ohio, USA, 1995 (Brochure).

Gerry Play Top High Chair (5301) & Gerry Triple Time High Chair (5107), Gerry Baby Products Co., Denver, Colorado, USA (Brochure).

Happyhort –Kombi High Chair, Storchenmuhle, Germany (Brochure).

*Primary Examiner*—Peter R. Brown
*Assistant Examiner*—Anthony D. Barfield
*Attorney, Agent, or Firm*—Ladas & Parry

[57] ABSTRACT

A convertible high chair including a base, a board attachable to a lower portion and to an upper portion of the base, a chair attachable to the base by means of mechanical fasteners, the chair when attached to the base, and the board when attached to the lower portion of the base forming a high chair, wherein the chair includes a plurality of chair parts which are storable separately and which are assembled together by means of mechanical fasteners, and the base includes a plurality of base parts which are storable separately and which are assembled together by means of mechanical fasteners, and wherein the base and the chair are adapted to be assembled separately, the board being attached to the upper portion of the base, such that the base and the chair form a chair and table set, and wherein each mechanical fastener is storable attached to at least one of the chair and the base parts.

1 Claim, 7 Drawing Sheets

HIGH CHAIR

FIELD OF THE INVENTION

The present invention relates to chairs for infants and young children generally, and particularly to a type of high chair which is convertible to a chair and table.

BACKGROUND OF THE INVENTION

High chairs for infants and young children which are convertible to a chair and table are known. For example, Gerry Baby Products Co., Denver, Colo., manufactures the Gerry Play Top High Chair (Model No. 5301) and the Gerry Triple Time High Chair (Model No. 5107). In both of these models, the high chair is formed by placing a chair on a surface of a table which has been turned on its side. The toppled table simply serves as a base for supporting the chair at a predetermined height. The chair is lifted off the table and the table is then righted in order to convert the high chair to a chair and table set.

Other convertible high chairs include the Evenflo Phases (TM) Multi-Use High Chair, manufactured by Evenflo Juvenile Furniture Co., Inc., Brantford, Ontario, and the Kombi brand high chair, manufactured by Storchenmuehle, Germany. These high chairs operate in generally the same fashion as the prior art mentioned above.

SUMMARY OF THE INVENTION

The present invention seeks to provide an improved convertible high chair. A high chair of the present invention, including all parts and mechanical accessories, may be much more compactly stored than convertible high chairs of the prior art.

There is thus provided in accordance with a preferred embodiment of the present invention, a convertible high chair including a base, a board attachable to a lower portion and to an upper portion of the base, a chair attachable to the base by means of mechanical fasteners, the chair when attached to the base, and the board when attached to the lower portion of the base forming a high chair, wherein the chair includes a plurality of chair parts which are storable separately and which are assembled together by means of mechanical fasteners, and the base includes a plurality of base parts which are storable separately and which are assembled together by means of mechanical fasteners, and wherein the base and the chair are adapted to be assembled separately, the board being attached to the upper portion of the base, such that the base and the chair form a chair and table set, and wherein each mechanical fastener is storable attached to at least one of the chair and the base parts.

In accordance with a preferred embodiment of the present invention, each mechanical fastener is decorative.

Additionally in accordance with a preferred embodiment of the present invention, each mechanical fastener includes a substantially tamper-proof bolt head.

Further in accordance with a preferred embodiment of the present invention, a decorative wrench is provided for fastening the mechanical fasteners, the decorative wrench being attachable to and storable with one of the mechanical fasteners.

BRIEF DESCRIPTION OF THE DRAWINGS

The present invention will be understood and appreciated from the following detailed description, taken in conjunction with the drawings in which.

DETAILED DESCRIPTION OF PREFERRED EMBODIMENTS

Figure 1A:
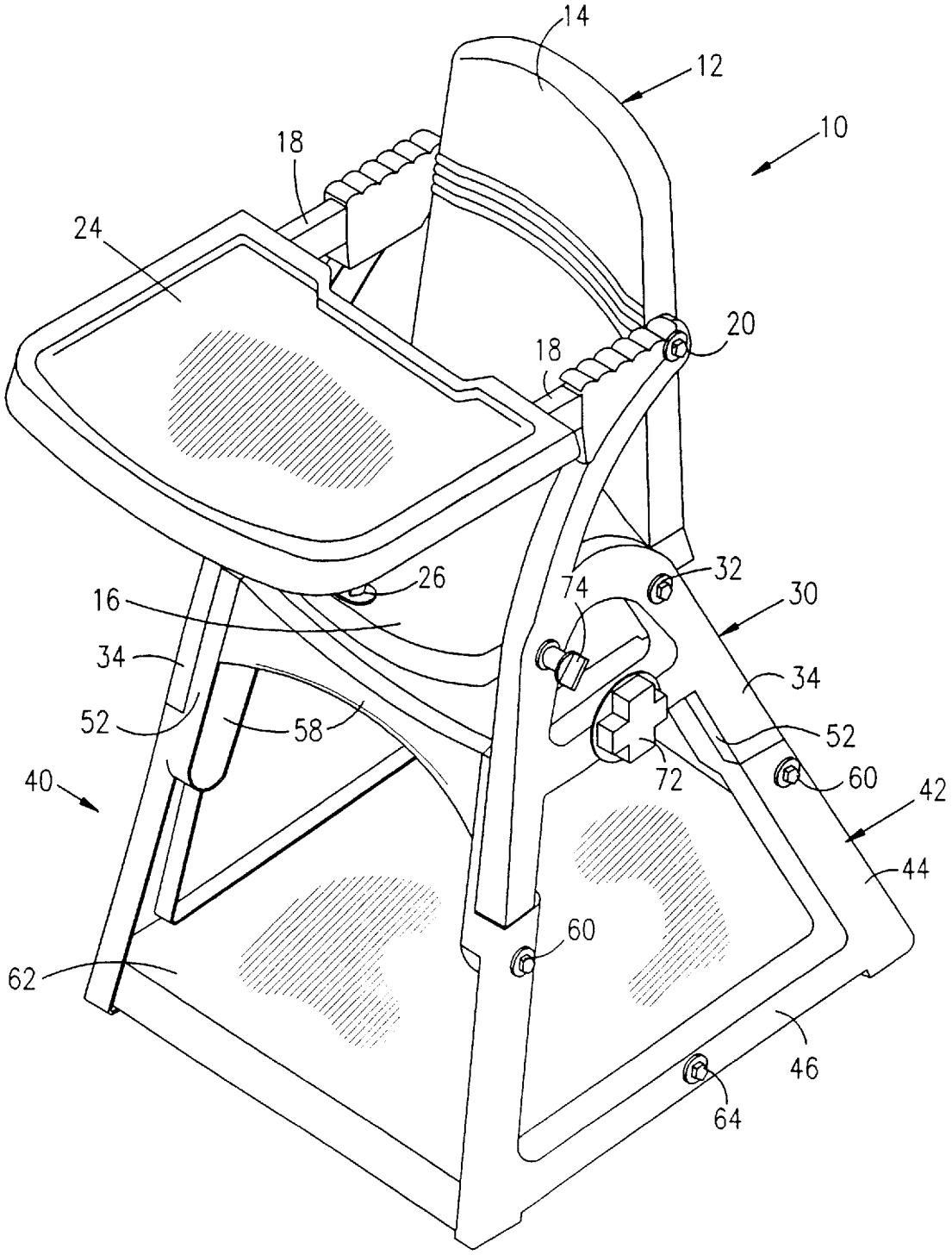
FIGS. 1A and 1B are simplified pictorial illustrations of a convertible high chair, including a chair and a base, constructed and operative in accordance with a preferred embodiment of the present invention, with a tray assembled and removed, respectively.
Figure 1B:
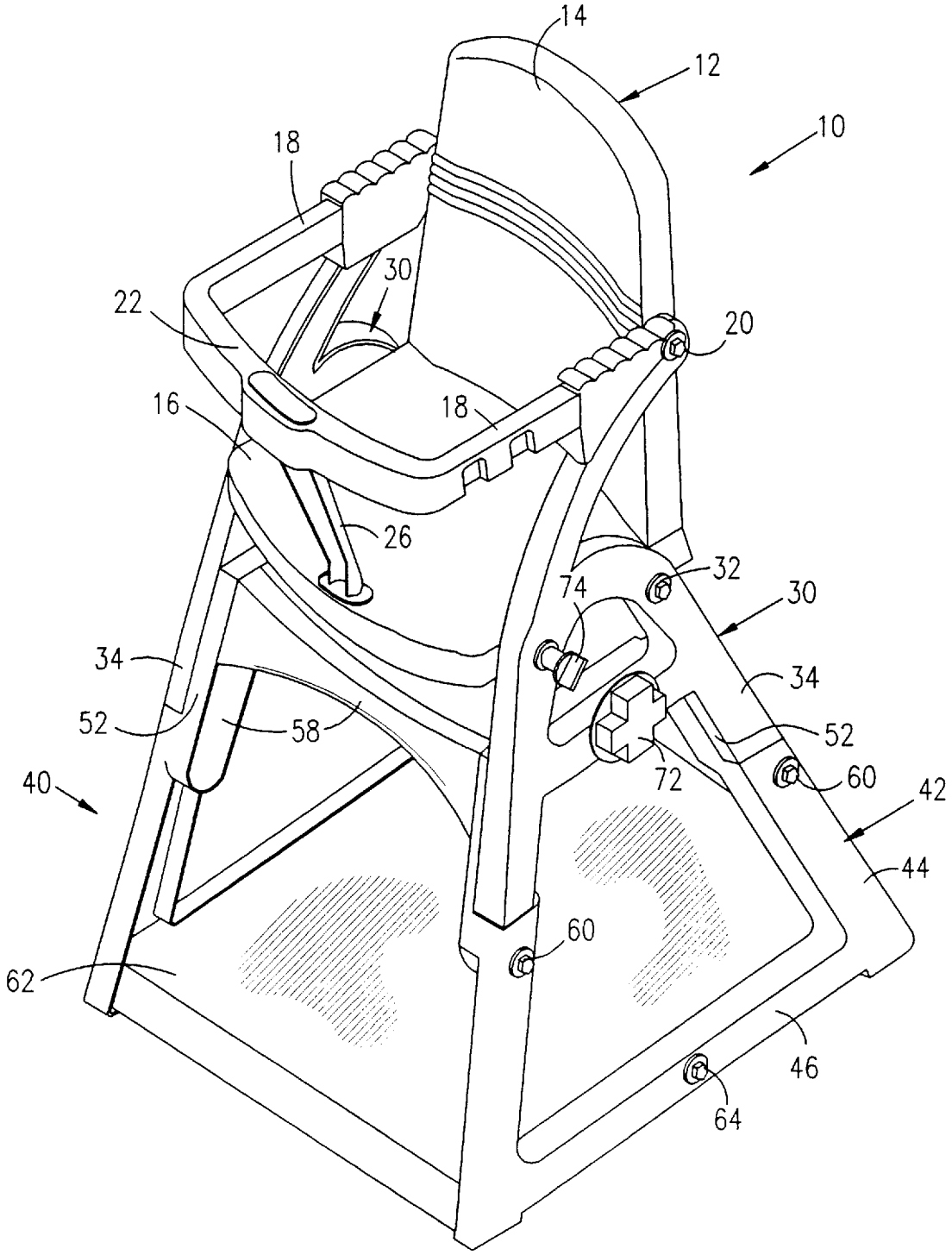
Figure 2:
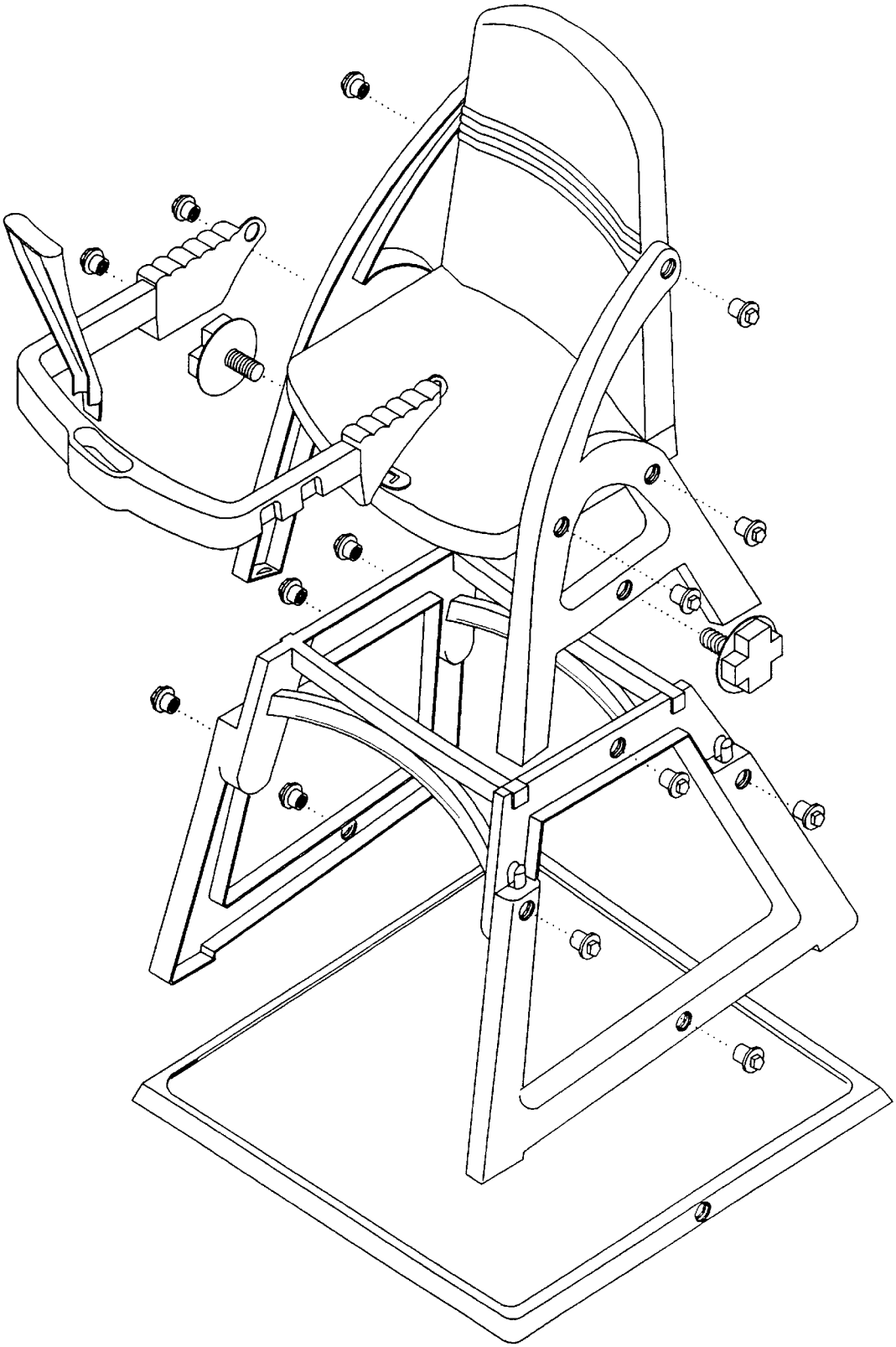
FIG. 2 is a simplified exploded pictorial illustration of the high chair of FIG. 1B.

Reference is now made to FIGS. 1A, 1B and 2 which illustrate a convertible high chair 10, constructed and operative in accordance with a preferred embodiment of the present invention. Convertible high chair 10 is preferably formed entirely of structural plastic, although other materials, such as wood, may be used.

Convertible high chair 10 preferably includes a chair 12 which includes a back support 14, a seat 16 and a pair of arm rests 18 which are pivotally attached to back support 14 by means of a plurality of mechanical fasteners 20 (only one fastener 20 being visible in FIGS. 1A and 1B). Arm rests 18 are preferably formed as one molded piece together with a cross bar 22. A tray 24 is preferably slidingly and removably attached to arm rests 18, as is well known for infant high chairs.

A strut 26 is preferably connected to cross bar 22 and seat 16. Strut 26 inter alia provides load support for tray 24. A pair of leg assemblies 30 is preferably pivotally attached by fasteners 20 to back support 14, and fixedly attached to seat 16 by a plurality of mechanical fasteners 32. The bottom portion of each leg assembly 30 is preferably shaped similarly to the capital letter A, having a pair of legs 34 and a transverse portion 36. Transverse portion 36 is preferably formed with a hole 38, as seen in FIG. 2.

It is a particular feature of the present invention that the individual parts of chair 12, i.e., back support 14, seat 16, arm rests 18, fasteners 20 and 32, tray 24, strut 26 and leg assemblies 30 may be disassembled and compactly stored. It is noted that fasteners 20 and 32 may be stored by fastening them to any of the corresponding parts of chair 12, thereby substantially preventing loss of fasteners 20 and 32 when disassembling high chair 10.

Chair 12 is attachable to a base 40. Base 40 preferably includes a pair of support members 42, each of which includes a pair of supports 44 connected by, and preferably integrally formed with, a grooved transverse portion 46. Each support 44 bears a leg 34 of chair 12. As seen in FIG. 2, each support 44 is preferably formed with a cup 48 which engages an end 50 of each leg 34.

As seen particularly in FIG. 2, each support member 42 preferably includes a frame member 52 formed with a central threaded hole 56. A pair of cross members 58 are preferably attached to frame member 52. A plurality of mechanical fasteners 60 preferably fasten cross members 58 to support members 42. A board 62 is preferably supported between grooved transverse portions 46 and fastened thereto by a pair of mechanical fasteners 64 (only one fastener 64 being visible in FIGS. 1A and 1B).

Figure 3:
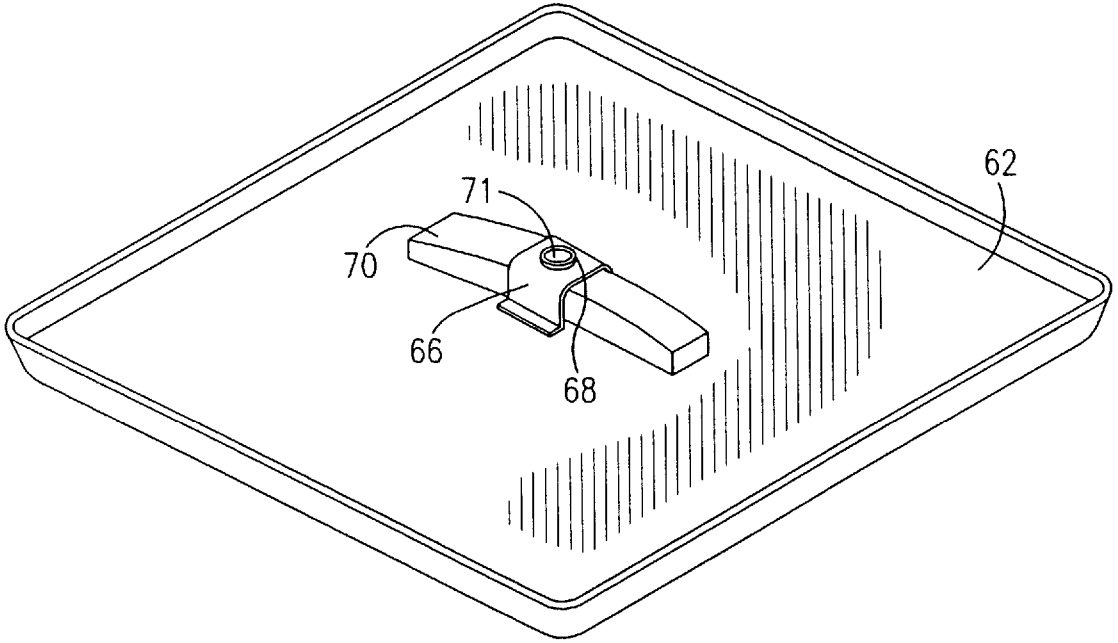
FIG. 3 is a simplified bottom view illustration of a board attachable to the base of the high chair of FIGS. 1A and 1B.

Reference is now made to FIG. 3 which is a bottom view illustration of board 62. It is seen that a central flange 66 is fixedly attached to the underside of board 62. Flange 66 is preferably formed with a threaded hole 68. A bar 70 is preferably snugly fit between the underside of board 62 and flange 66. Bar 70 is preferably provided with a central threaded hole 71.

It is a particular feature of the present invention that the individual parts of base 40, i.e., support members 42, cross members 58, board 62 and fasteners 60 and 64, may be disassembled and compactly stored. It is noted that fasteners 60 and 64 may be stored by fastening them to any of the corresponding parts of base 40, thereby substantially preventing loss of fasteners 60 and 64 when disassembling high chair 10.

Chair 12 may be fastened to base 40 by means of a pair of hand nuts 72, each of which passes through a corresponding hole 38 and threadably engages with a corresponding threaded hole 56.

All of the mechanical fasteners used in the assembly of convertible high chair 10 are preferably decorative. Additionally, the mechanical fasteners preferably include a substantially tamper-proof bolt head, such as a pentagonal shaped head shown in FIGS. 1A, 1B and 2. All of the parts of chair 12 and base 40 may be decorative and/or colored differently.

Figure 4A:
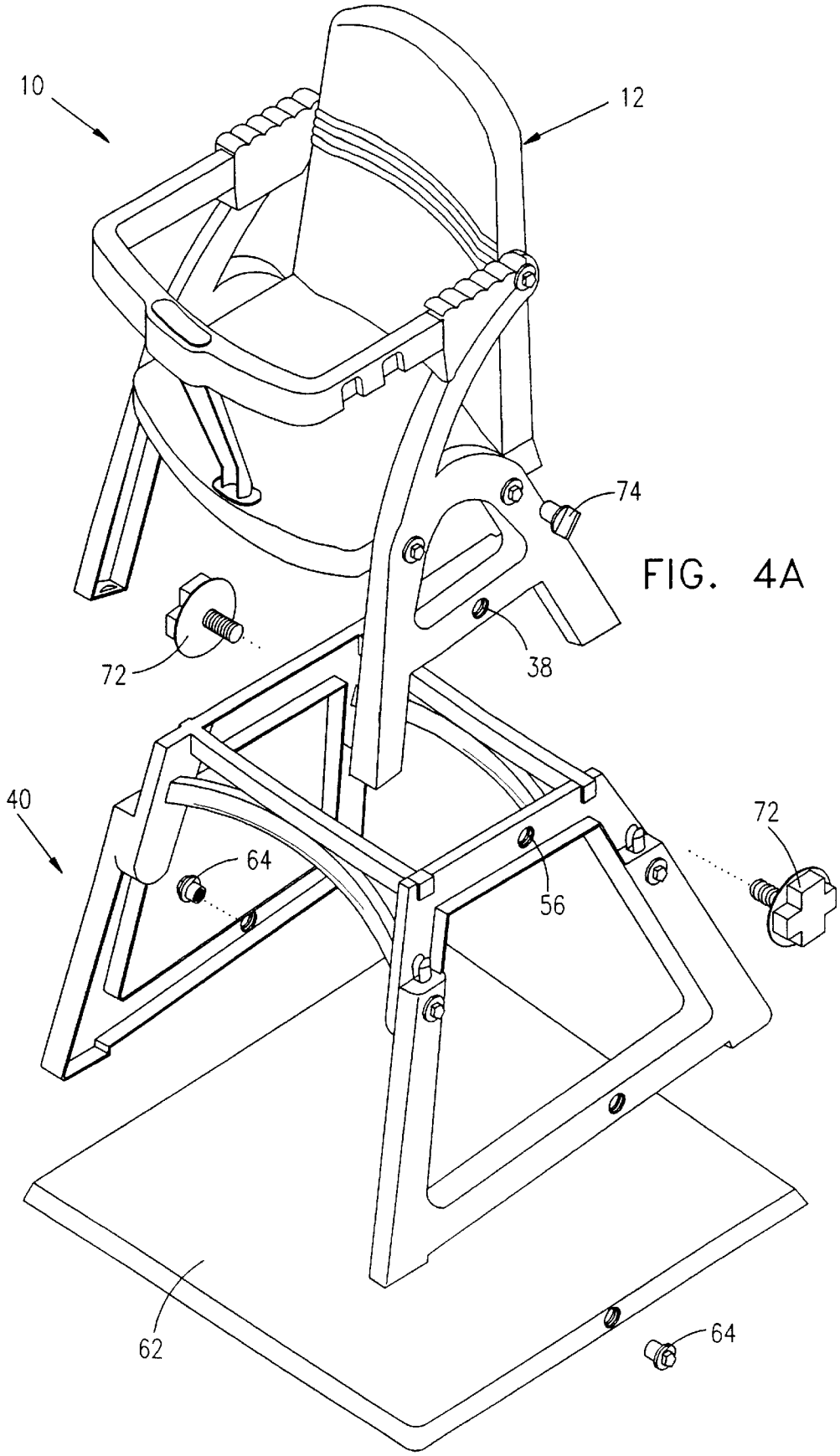
FIG. 4A is a simplified pictorial illustration of removing the chair from the base.

Reference is now made to FIG. 4A. In order to convert high chair 10 from the high chair configuration shown in FIGS. 1A, 1B and 2, hand nut 72 is first removed, thereby allowing chair 12 to be removed from base 40. A decorative wrench 74 may be used to disassemble the mechanical fasteners of convertible high chair 10. Preferably, decorative wrench 74 fits snugly on any of the mechanical fasteners so as to become an aesthetic feature of high chair 10. Wrench 74 may be stored conveniently with the parts of high chair 10, by snugly placing wrench 74 on any of the mechanical fasteners prior to storage thereof By removing fasteners 64, board 62 may be removed from grooved transverse portions 46.

Figure 4B:
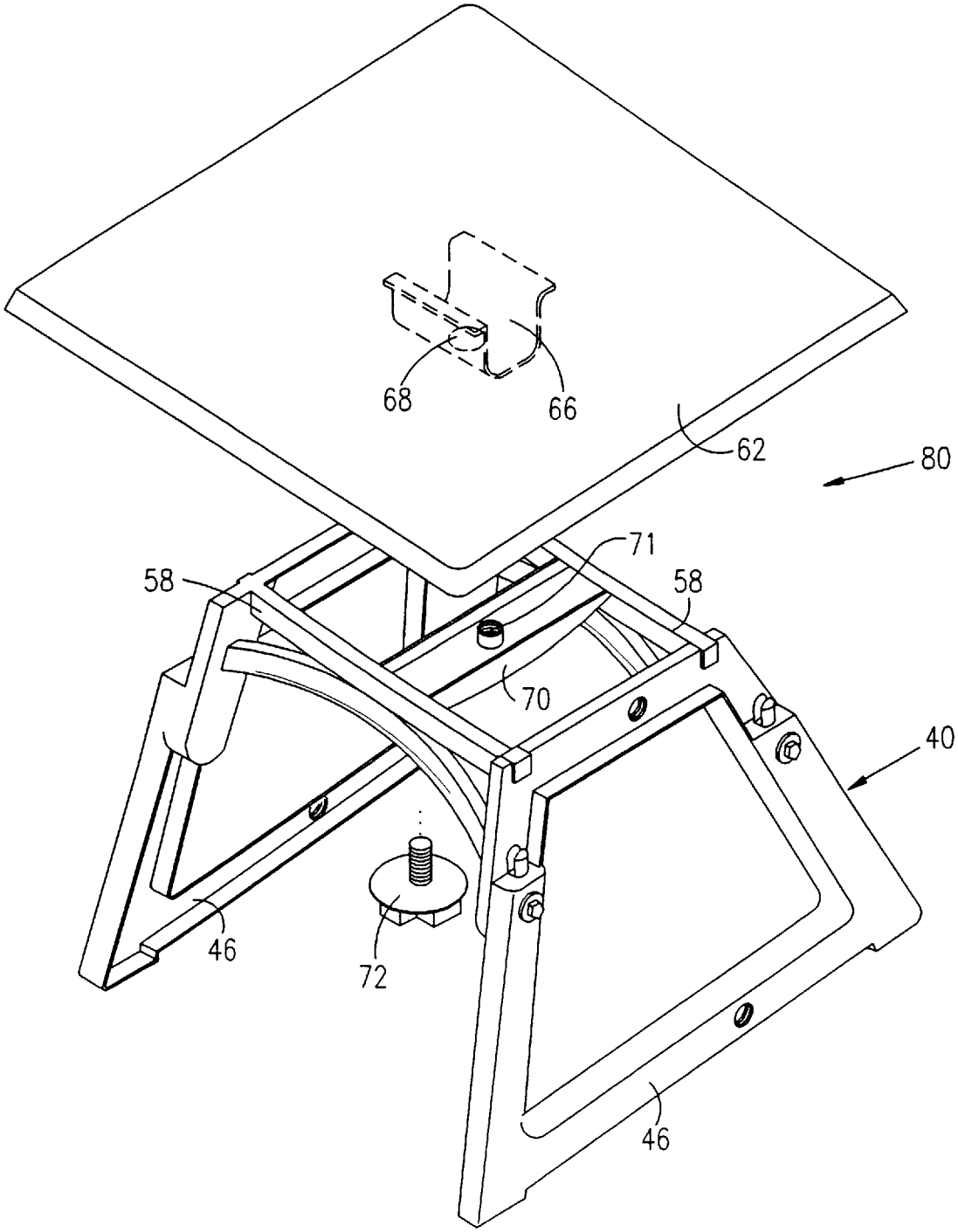
FIG. 4B is a simplified pictorial illustration of removing the board from a lower portion of the base in order to mount the board on an upper portion of the base, thereby forming a table.

Reference is now made to FIG. 4B. Board 62 may now be placed on cross members 58. Bar 70 may be removed from flange 66 and placed between cross members 58, underneath flange 66. One of hand nuts 72 may then be threadably engaged with threaded hole 68 of flange 66 and threaded hole 71 of bar 70, thereby fixedly attaching board 62 to the upper portion of base 40 and thus forming a table 80.

Figure 5:
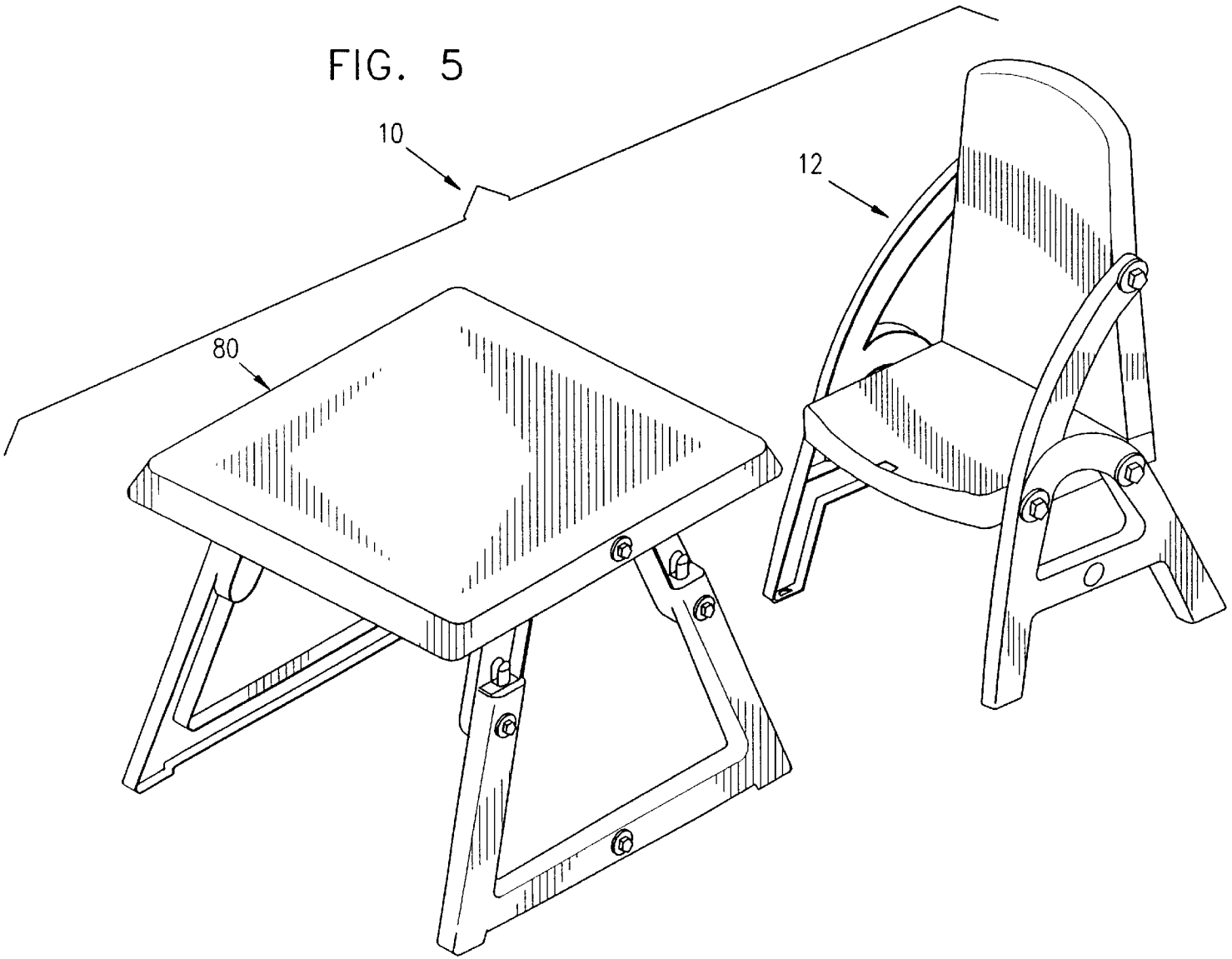
FIG. 5 is a simplified pictorial illustration of the convertible high chair of FIG. 1B converted to a chair and table set.

FIG. 5 illustrates convertible high chair 10 of FIGS. 1A, 1B and 2, converted to chair 12 and table 80.

It is appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable subcombination.

It will be appreciated by persons skilled in the art that the present invention is not limited to what has been particularly shown and described hereinabove. Rather, the scope of the present invention is defined only by the claims that follow:

What is claimed is:

1. A convertible high chair comprising:

a chair comprising a back support, a seat and a pair of arm rests which are pivotally attached to said back support by means of a first plurality of mechanical fasteners, said arm rests being formed as one integral piece together with a cross bar which extends between said arm rests;

a tray slidingly and removably attached to said arm rests;

a strut connected to said cross bar and to said seat, said strut supporting said tray;

a pair of leg assemblies which are pivotally attached by said first plurality of fasteners to said back support, and fixedly attached to said seat by a second plurality of mechanical fasteners, wherein a bottom portion of each leg assembly comprises a pair of legs and a transverse portion, said transverse portion being formed with a hole;

wherein said first and second pluralities of mechanical fasteners are storable by fastening to any of said back support, said seat, said arm rests, said tray, said strut and said pair of leg assemblies;

and wherein said chair is attachable to a base, said base comprising a pair of support members, each of said support members comprising a pair of supports connected by, and integrally formed with, a grooved transverse portion;

wherein each said support supports one of said legs of said chair, and wherein each said support is formed with a cup which engages an end of each said leg;

wherein each said support member comprises a frame member formed with a central threaded hole, and wherein a pair of cross members are attached to said frame member, said cross members being attached to said support members by means of a third plurality of mechanical fasteners;

and further comprising a board supported between said grooved transverse portions and fastened thereto by a fourth pair of mechanical fasteners, a central flange being fixedly attached to an underside of said board, said flange being formed with a threaded hole, and wherein a bar is fit between the underside of said board and said flange, said bar being provided with a central threaded hole;

wherein said third and fourth pluralities of fasteners are storable by fastening to any of said support members, said cross members and said board, and wherein at least one of said pluralities of said fasteners comprises a pentagonally-shaped head;

and wherein said chair is selectively fastenable to said base by means of a pair of hand nuts, each said hand nut passing through a corresponding one of said holes of said transverse portions of said chair and threadably engaging with a corresponding one of said threaded holes of said frame members of said base;

and wherein said chair is selectively removable from said base by removing said pair of hand nuts from said holes of said transverse portions of said chair and said threaded holes of said frame members of said base, thereby allowing said chair to be removed from said base and said board to be removed from said grooved transverse portions, and wherein a table is constructable by placing said board on said cross members of said frame member, removing said bar from said flange and placing said bar between said cross members underneath said flange, and threadably engaging one of said hand nuts with said threaded hole of said flange and said central threaded hole of said bar, thereby fixedly attaching said board to an upper portion of said base.

* * * * *